US008192171B2

(12) United States Patent
Mehaffey et al.

(10) Patent No.: US 8,192,171 B2
(45) Date of Patent: Jun. 5, 2012

(54) COMPRESSOR SYSTEM

(75) Inventors: James D. Mehaffey, Mooresville, NC (US); Jason A. Roberge, Cornelius, NC (US); Frederick E. Bender, Mooresville, NC (US)

(73) Assignee: Ingersoll-Rand Company, Piscataway, NJ (US)

( * ) Notice: Subject to any disclaimer, the term of this patent is extended or adjusted under 35 U.S.C. 154(b) by 718 days.

(21) Appl. No.: 12/354,269

(22) Filed: Jan. 15, 2009

(65) Prior Publication Data

US 2010/0178174 A1 Jul. 15, 2010

(51) Int. Cl.
*F04B 41/06* (2006.01)
*F04B 49/20* (2006.01)
*F25B 7/00* (2006.01)

(52) U.S. Cl. ..... 417/2; 62/175

(58) Field of Classification Search ..... 417/2; 62/175, 62/510

See application file for complete search history.

(56) References Cited

U.S. PATENT DOCUMENTS

| | | | | |
|---|---|---|---|---|
| RE29,621 | E | 5/1978 | Conley et al. | |
| 4,102,149 | A | 7/1978 | Conley et al. | |
| 4,259,038 | A | 3/1981 | Jorgensen et al. | |
| 4,526,513 | A | 7/1985 | Bogel | |
| 4,560,319 | A | 12/1985 | Blotenberg | |
| 4,646,530 | A | 3/1987 | Huenniger | |
| 5,522,707 | A | 6/1996 | Potter | |
| 6,185,946 | B1 | 2/2001 | Hartman | |
| 7,240,502 | B2 | 7/2007 | Cho et al. | |
| 2005/0244277 | A1 | 11/2005 | Hurst, Jr. et al. | |
| 2006/0225445 | A1 | 10/2006 | Lifson et al. | |
| 2007/0107449 | A1 * | 5/2007 | Crane et al. | 62/175 |
| 2007/0227167 | A1 | 10/2007 | Shapiro | |

* cited by examiner

*Primary Examiner* — Joseph L Williams
(74) *Attorney, Agent, or Firm* — Michael Best & Friedrich LLP

(57) ABSTRACT

A compressor system includes a lead compressor operable to produce a flow of compressed fluid at a first output and a lag compressor operable to produce a flow of compressed fluid at a second output. The sum of the first output and the second output defines a system output. A lead variable speed motor is operable to drive the lead compressor at a first compressor speed to vary the first output and a lag variable speed motor is operable to drive the lag compressor at a second compressor speed to vary the second output. A sensor is operable to measure a system load, and a lead motor drive is operable to control the speed of the lead variable speed motor and to set a desired operating state of the lag variable speed motor in response to a comparison of the system load and the system output.

25 Claims, 4 Drawing Sheets

COMPRESSOR SYSTEM

BACKGROUND

The present invention relates to compressor systems, and more particularly to a compressor system utilizing a lead compressor and at least one lag compressor.

In some applications, it is more efficient to use two or more smaller compressors rather than one large compressor. Generally, a system controller controls the output of the various compressors in the system by controlling the output of each compressor.

SUMMARY

One construction of the invention provides a compressor system that includes a lead compressor operable to produce a flow of compressed fluid at a first output and a lag compressor operable to produce a flow of compressed fluid at a second output. The sum of the first output and the second output defines a system output. A lead variable speed motor is operable to drive the lead compressor at a first compressor speed to vary the first output and a lag variable speed motor is operable to drive the lag compressor at a second compressor speed to vary the second output. A sensor is operable to measure a system load, and a lead motor drive is operable to control the speed of the lead variable speed motor and to set a desired operating state of the lag variable speed motor in response to a comparison of the system load and the system output.

In another construction, the invention provides a compressor system that includes a lead compressor operable to produce a flow of compressed fluid at a first output and a lag compressor operable to produce a flow of compressed fluid at a second output. The sum of the first output and the second output defines a system output. A lead variable speed motor is operable to drive the lead compressor at a first compressor speed to vary the first output, and a lag variable speed motor is operable to drive the lag compressor at a second compressor speed to vary the second output. A sensor is operable to measure a system load. A lag motor drive is operable to control the speed of the lag variable speed motor. A lead motor drive is operable in a first region of operation to drive the lead variable speed motor at a speed that maintains the first output between a first minimum and a first maximum and to provide a desired operating state to the lag motor drive to maintain the second output between a second minimum and a second maximum. The lead motor drive is also operable in a second region of operation to drive the lead variable speed motor at a speed that maintains the first output between a third minimum and a third maximum, the third minimum being different than the first minimum.

In yet another construction, the invention provides a method of operating multiple compressors in a compressor system. The method includes operating a lead compressor between a minimum output and a maximum output to define a lead compressor output, operating a lag compressor between a minimum output and a maximum output to define a lag compressor output, combining the lead compressor output and the lag compressor output to define a system output, measuring a system load with a sensor, comparing the system load and the system output, setting the speed of the lead compressor using a lead variable speed drive, determining a desired operating state for the lag compressor using the lead variable speed drive and a comparison of the system load and the system output, providing to a lag variable speed drive the desired operating state, and operating the lag compressor in the desired operating state in response to receipt of the desired operating state.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The output of a compressor may be described in different ways. For example, the output may be described as a percentage or percent output. The percent output of a compressor is simply the flow rate of compressed fluid exiting the compressor divided by the maximum flow rate of compressed fluid that the compressor is capable of outputting, converted to a percentage. The percent output of the compressor will be referred to herein as the output. The output of a compressor may also be described in terms of its turn down. The turn down capability of a compressor indicates the range at which the compressor can operate. For example, if a compressor has a turn down of 70%, then the compressor is able to produce an output between 30% and 100%. If a compressor is turned down 70%, then the compressor is operating at 30%, or with 30% output.

Figure 1:
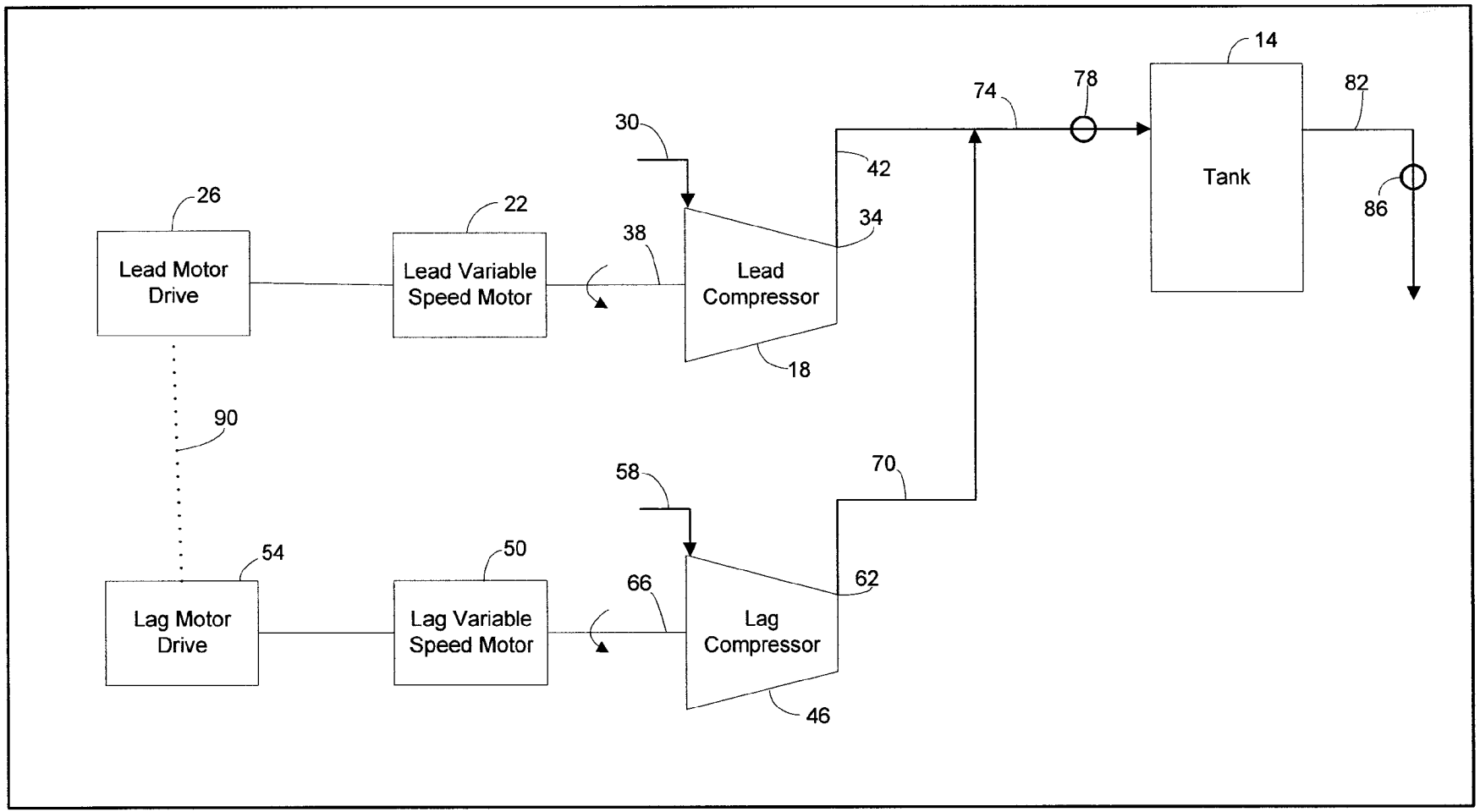
FIG. 1 is a schematic of a compressor system.

FIG. 1 illustrates a compressor system 10 that operates without a system controller and includes a lead compressor assembly, a lag compressor assembly, and a holding tank 14. The lead compressor assembly includes a lead compressor 18, a lead variable speed motor 22, and a lead motor drive 26.

The lead compressor 18 is a rotary screw compressor and may be oil-flooded or oil-less. The lead compressor 18 contains an inlet 30 and an outlet 34. The lead compressor 18 draws in a working fluid, such as air, through the inlet 30 and discharges or outputs the working fluid as a flow of compressed fluid through the outlet 34. The lead compressor 18 may compress other working fluids such as nitrogen, refrigerant, ammonia, etc.

The lead variable speed motor 22 preferably includes a variable-frequency motor that drives a motor shaft 38 coupled to the lead compressor 18 to drive the lead compressor 18. The lead variable speed motor 22 receives a signal from the lead motor drive 26 to drive the lead compressor 18, via the lead motor shaft 38, at a desired speed. While several variable speed motors are possible, preferred constructions employ AC variable frequency motors.

The lag compressor assembly includes a lag compressor 46, a lag variable speed motor 50, and a lag motor drive 54. The lag compressor 46 is a rotary screw compressor of the same size as the lead compressor 18 and operates in the same manner as the lead compressor 18. In other constructions the lag compressor 46 may be a different size or type of compressor.

The lag variable speed motor 50 is a variable-frequency motor and operates in a similar way as the lead variable speed motor 22. The lag variable speed motor 50 drives a motor shaft 66 that is coupled to the lag compressor 46 to drive the lag compressor 46. The lag variable speed motor 50 receives a signal from the lag motor drive 54 to drive the lag compressor 46, via the lag motor shaft 66, at a desired speed. While several variable speed motors are possible, preferred constructions employ AC variable frequency motors.

The lag motor drive 54 preferably includes a solid state motor drive that includes a processor and that is connected to the lag variable speed motor 50. The processor receives a signal from the lead motor drive 26 (discussed below) corresponding to a desired operating state (e.g., on or off) that the processor interprets as an instruction to either operate the lag compressor 46 or shut down the lag compressor 46. The lag motor drive 54 receives input power at a fixed voltage and frequency (e.g., 480 volts, 60 Hz) and converts the power to a desired voltage and frequency to drive the lag variable speed motor 50 at a desired speed. The desired speed is determined by the lag motor drive 54 in response to a comparison of the system load 82 and the system output 74. Of course, other lag motor drives such as analog motor drives may be employed if desired.

The holding tank 14 receives the lead compressor output 42 and the lag compressor output 70, defined as a system output 74. A load is connected to the holding tank 14 and consumes or uses the compressed fluid held in the holding tank 14. An output sensor 78 is located upstream of the holding tank 14 and is operable to output a signal representative of the system output 74. A load sensor 86 is located downstream of the holding tank 14 or inside the holding tank 14 and is operable to output a signal representative of a system load 82. It should be noted that while a tank 14 is illustrated herein, other constructions may eliminate the tank or utilize other features such as piping to perform the function of the tank 14. In other constructions, the output sensor 78 may be positioned differently. For example, an output sensor may be located at the output 34 of the lead compressor 18 or at the output 62 of the lag compressor 46 to sense the system output. In yet other constructions, multiple output sensors may be employed. For example, each compressor could include an output sensor positioned adjacent the output to sense the system output. In addition, the output sensor could be positioned anywhere along the discharge line from one or both the lead and lag compressors to the point of use.

In preferred constructions, the lead motor drive 26 is a solid state motor drive that includes a processor and that is connected to the lead variable speed motor 22. The lead motor drive 26 receives a signal from the output sensor 78 corresponding to the system output 74 and a signal from the load sensor 86 corresponding to the system load 82. The lead motor drive 26 compares the system output 74 to the system load 82 and determines a desired speed for the lead variable speed motor 22. The lead motor drive 26 receives input power at a fixed voltage and frequency (e.g., 480 volts, 60 Hz) and converts the power to a desired voltage and frequency to drive the lead variable speed motor 22 at the desired speed.

The lead motor drive 26 also provides a signal to the lag motor drive 54 instructing the lag motor drive 54 to either operate the lag variable speed motor 50 or to allow the lag variable speed motor 50 to idle or shut down. If the system load 82 is less than or equal to the maximum output of the lead compressor 18, the lead motor drive instructs the lag variable speed motor 50 to idle or shut down. If the system load 82 is greater than the maximum output of the lead compressor 18, the lead motor drive 26 instructs the lag variable speed motor 50 to operate. Communication 90 between the lead motor drive 26 and the lag motor drive 54 can be achieved by any reasonable means. For example, the communication 90 may be provided by an electrically conductive wire with a switching mechanism, serial communication, wireless technology, etc. Of course, other lead motor drives such as analog motor drives may be employed if desired.

Although the logic of the lead motor drive 26 is described herein with the use of both a load sensor 86 and an output sensor 78, other constructions may eliminate the output sensor 78 and rely on compressor performance curves.

Figure 2:
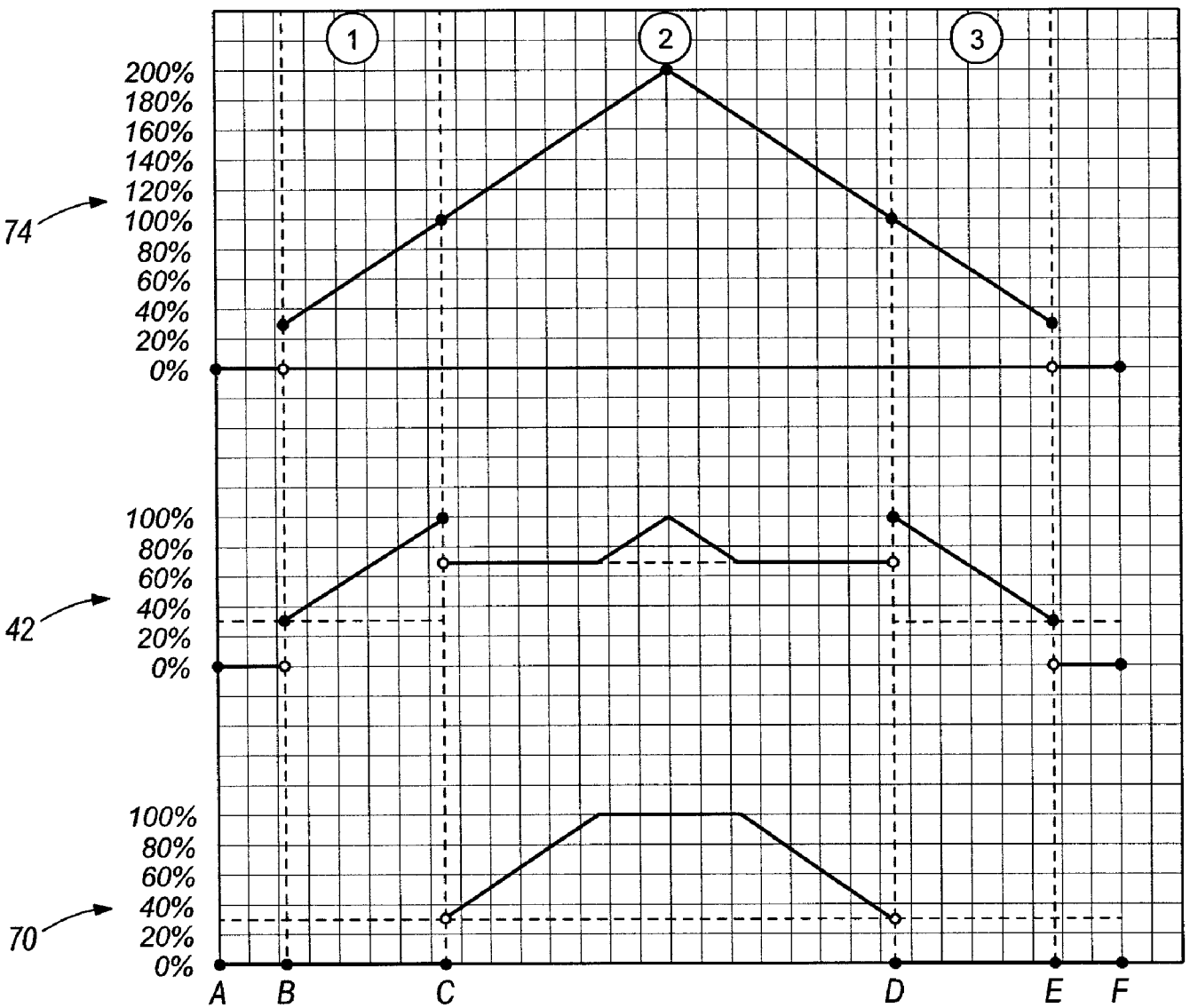
FIG. 2 is a stacked graph illustrating the operating regions of the compressor system of FIG. 1.
Figure 3:
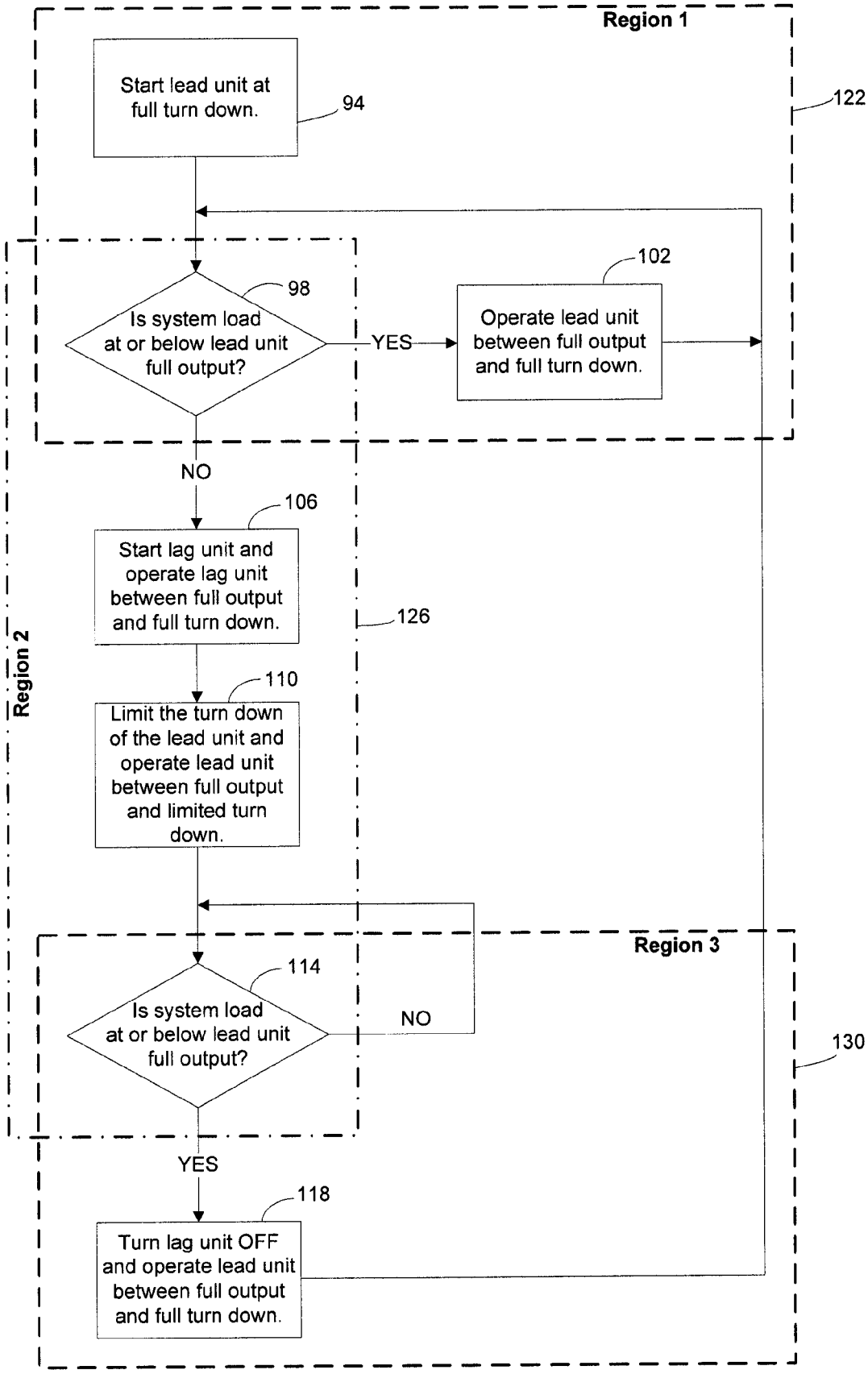
FIG. 3 is a logic flowchart illustrating a logic of the lead motor drive in the compressor system of FIG. 1.

Operation of the compressor system 10 will now be described in detail with reference to FIGS. 2 and 3. FIG. 2 is a stacked graph illustrating the operating regions of the compressor system 10 illustrated in FIG. 1. Along the x-axis, operating points A, B, C, D, E, F of the compressor system 10 are labeled and correspond to transition points into and out of the different regions of operation. Along the y-axes, the lag compressor output 70, the lead compressor output 42, and the system output 74 are displayed as percentages. The graphs are stacked and aligned to illustrate how the lead and lag compressors 18, 46 operate in response to changes in the system load 82. It is assumed that the system output 74 changes ideally and is equal the system load 82. For simplicity, the system output 74 is defined as the sum of the lead and lag compressor outputs 42, 70 and ranges from 0% to 200%. FIG. 3 is a logic flowchart illustrating a logic of the lead motor drive 26 that may be employed to control the compressor system 10 as shown in FIG. 2. In the following example, it is further assumed that the lead and lag compressors 18, 46 are substantially identical. Although the following example will be described as the system load 74 changes as shown in the graph of FIG. 2 from left to right, the compressor system 10 may also move back and forth between the regions of operation.

At operating point A, the lead compressor output 42 and the lag compressor output 70 are both 0%, and the system output is also 0%. Operation of the compressor system at 0% output may refer to an idle state or shut down state of the compressor system 10.

With reference to FIG. 2, when the system load 82 increases to 30%, the compressor system 10 begins to operate in a first low load region of operation (Region 1 122 of FIG. 3). At operating point B, the lead motor drive 26 instructs the lead variable speed motor 22 to drive the lead compressor 18 such that it operates at its minimum output of 30% (turned down 70%) as shown at block 94 of FIG. 3, while the lag compressor 46 idles or is shut down. Because it is assumed that the lead and lag compressors 18, 46 cannot operate between 0% and 30%, there is a discontinuity in the graph at operating point B. The minimum system output 74 in the low load region of operation is 30%, which is the minimum output of the lead compressor 18. Thus, if operation between 0% and 30% is required, cycling operation could be employed.

As the system load 82 increases over 30%, the system output 74 increases to meet the demand (see FIG. 2). If the system load 82 is less than or equal to the lead compressor's full output, then the lead compressor 18 will operate at the system load 82, between 30% and 100% (70% turn down), also referred to as operating between full turn down and full output as shown at block 102 of FIG. 3. Thus, the lead compressor 18 alone satisfies demand between 30% and 100% in the first low load region of operation.

At operating point C, the compressor system 10 transitions into a high load region of operation (Region 2 126 of FIG. 3), in which operation of two compressors is required to meet the system load 82. In the high load region of operation, the lead motor drive 26 instructs the lag motor drive 54 to begin operating the lag compressor 46. The lag motor drive 54 operates the lag compressor 46 between 30% and 100% (70% turn down) as shown at block 106 of FIG. 3. The lead motor drive 26 also limits the turn down of the lead compressor 18, as shown at block 110 of FIG. 3, to operate the lead compressor 18 between 70% and 100% output (30% turn down), such that the minimum output of the lead compressor 18 in the high load region of operation is 70%.

As the system output 74 varies between 100% and 200%, the lead compressor output 42 varies between 70% and 100% (30% turn down) while the lag compressor output 70 varies between 30% and 100% (70% turn down). FIG. 2 illustrates one example of how operation of the lead and lag compressors 18, 46 may be changed in order to produce the system output 74 shown in the graph. Of course, the lead and lag compressors 18, 46 may be adjusted in any reasonable manner such that the lead compressor output 42 and the lag compressor output 70 are within their respectively defined output ranges and the sum of their outputs 42, 70, the system output 74, is equal to the system load 82.

The compressor system 10 will continue to operate in the high load region of operation, in which the lead motor drive 26 will operate both the lead compressor 18 and the lag compressor 46 to meet the system load 82, until the system load 82 is no longer greater than the lead compressor's maximum output.

At operating point D, the compressor system transitions into a second low load region of operation (Region 3 130 of FIG. 3) that is similar to the first low load region of operation. The lead motor drive 26 will reset the minimum speed of the lead variable speed motor 22 to drive the lead compressor 18 such that it operates between its minimum output of 30% (turned down 70%) and its maximum output of 100% as shown at block 118 of FIG. 3. This is also referred to as operating the lead compressor 18 between full output and full turn down. The lead motor drive 26 instructs the lag compressor 46 to idle or shut down such that it outputs 0% in the second low load region of operation.

Operation in this manner will continue until the system load 82 decreases to a value less than the minimum output of the lead compressor 18, at which point the lead motor drive 26 will instruct the lead variable speed motor 22 to shut down and begin cycling operation, or until the system load 82 increases above 100%. At operating point E, the system output 74 is equal to the minimum output of the lead compressor 18. Because it is assumed that the lead compressor 18 cannot operate below 30%, there is a discontinuity in the graph at operating point E. Again, cycling operation could be employed to provide system output 74 between 0% and 30%.

In general, the low load region of operation may be defined as a region of operation in which the system load 82 may be met by operation of only one compressor (e.g., the lead compressor 18). The lead compressor 18 will operate between a first minimum and a first maximum (e.g., 30% and 100% or with 70% turn down), while the second compressor (e.g., the lag compressor 46) will idle or shut down. When the system load 82 increases to the first compressor's maximum output, the system will transition to a high load region of operation, in which two compressors 18, 46 are required to operate in order to achieve the system load 82. The lag compressor 46 will operate between a second minimum and a second maximum (e.g., 30% and 100% or with 70% turn down), and the lead compressor 18 will operate between a third minimum and the first maximum (e.g., 70% and 100% or 30% turn down). The lead compressor 18 and the lag compressor 46 will operate such that the system output 74 equals the system load 82. When the system load 82 decreases to the maximum output of the lead compressor 18, the compressor system 10 will transition to a second low load region of operation, in which only the lead compressor 18 operates to meet the system load 82. The minimum speed of the lead compressor 18 will be adjusted such that the lead compressor 18 will again operate between the first minimum and the second minimum (e.g., 30% and 100% or with 70% turn down). The lag compressor 46 will again idle, or operate at 0%.

The logic of the lead motor drive 26 may also operate the system in a slightly different manner by modifying its definitions of the regions of operation. For example, the compressor system 10 may operate in the low load region of operation when the system load is less than 90%, rather than 100%. In this situation, the operating points corresponding to the transition points on the graph will shift to reflect the changes in the operating regions.

Figure 4:
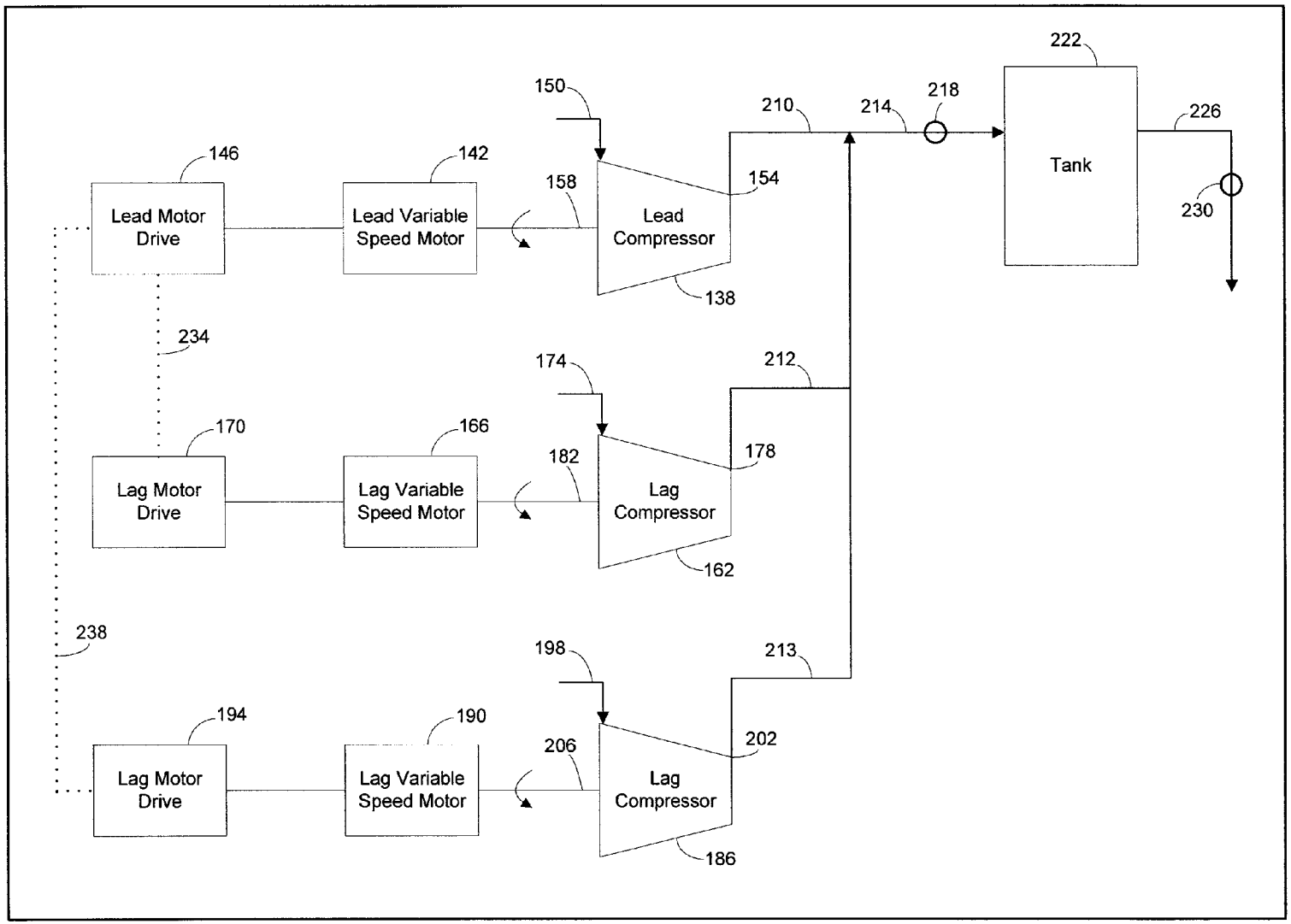
FIG. 4 is a schematic of a compressor system similar to FIG. 1, including multiple lag compressors.

With reference to FIG. 4, other constructions of the present invention may include compressor systems 134 with more than one lag compressor 162, 186. The operation of the compressor system 134 in the illustrated construction is similar to the operation of the compressor system 10 shown in FIG. 1 and will therefore be discussed only briefly. The lead motor drive 146 is operable to send instructions to each of the lag motor drives 170, 194 as well as the lead variable speed motor 142. Also, assuming the compressor system 134 comprises one lead compressor 138 and two lag compressors 162, 186, each operable between 30% and 100% (70% turn down), the total system output 214 will equal 300%.

The lead motor drive 146 will receive a signal corresponding to the system output 214 from an output sensor 218 and a signal corresponding to the system load 226 from a load sensor 230. The lead motor drive 146 will compare the system output 214 to the system load 226 and determine a desired speed for the lead variable speed motor 142 and determine the desired operating states for each of the lag variable speed motors 166, 190.

The lag motor drives 170, 194 each communicate with the lead motor drive 146 to receive a signal corresponding to a desired operating state that the lag motor drives 170, 194 interpret as an instruction to either operate the lag compressor 162, 186 or to shut down the lag compressor 162, 186. The lag motor drives 170, 194 determine a desired speed of each lag compressor 162, 186, respectively. The lag motor drives 170, 194 will send a signal to the lag variable speed motors 166, 190 to drive the lag compressors 162, 186 at the desired speeds determined by the lag motor drives 170, 194 in response to a comparison of the system load 226 and the system output 214.

The compressor system 134 is operable in a low load region of operation, an intermediate load region of operation, and a high load region of operation. The low load region of operation may be defined as a region of operation in which the system load 226 is less than 100%, in which only operation of the lead compressor 138 is required to meet the system load 226. The intermediate region of operation may be defined as a region of operation in which the system load 226 is greater than 100% and less than or equal to 200%, in which operation of two compressors (e.g., the lead compressor 138 and the first lag compressor 162) is required to meet the system load 226. Finally, the high load region of operation may be defined as a region of operation in which the system load 226 is greater than 200% and less than or equal to 300%, in which operation of three compressors (e.g., the lead compressor 138, the first lag compressor 162, and the second lag compressor 186) is required to meet the system load 226. The operation of the compressors 138, 162, 186 and the transition between each region of operation is similar to the example described above.

The lead motor drive 146 typically operates the compressor system 134 with the least number of compressors. In this way, the lead motor drive 146 uses the compressor system 134 most efficiently. However, in some constructions, it may be more efficient to not operate with the absolute minimum number of compressors. For example, it may be determined to be more efficient to operate the compressor system 134 such that it transitions between regions of operation when the compressors operate within 10% of their maximum outputs. The most efficient operation would be determined and preprogrammed into the logic of the lead motor drive 146 during the design of the compressor system 134.

Thus, the invention provides, among other things, a compressor system that operates a plurality of compressors without the use of a system controller. Various features and advantages of the invention are set forth in the following claims.

We claim:

1. A compressor system comprising:

a lead compressor operable to produce a flow of compressed fluid at a first output;

a lag compressor operable to produce a flow of compressed fluid at a second output, the sum of the first output and the second output defining a system output;

a lead variable speed motor operable to drive the lead compressor at a first compressor speed to vary the first output;

a lag variable speed motor operable to drive the lag compressor at a second compressor speed to vary the second output;

a sensor operable to measure a system load;

a lead motor drive operable to control the speed of the lead variable speed motor and to set a desired operating state of the lag variable speed motor in response to a comparison of the system load and the system output; and a lag motor drive operable to control the speed of the lag variable speed motor, wherein the lag motor drive communicates with the lead motor drive to receive the desired operating state from the lead motor drive.

2. The compressor system of claim 1, wherein the lead compressor and the lag compressor discharge a fluid at a common pressure.

3. The compressor system of claim 1, wherein the lag motor drive communicates with the lead motor drive through a serial communications connection.

4. The compressor system of claim 1, wherein the operating state is one of "on" and "off".

5. The compressor system of claim 4, wherein in the "on" state, the lag motor drive controls the speed of the lag variable speed motor in response to the comparison.

6. A compressor system comprising:

a lead compressor operable to produce a flow of compressed fluid at a first output;

a lag compressor operable to produce a flow of compressed fluid at a second output, the sum of the first output and the second output defining a system output;

a lead variable speed motor operable to drive the lead compressor at a first compressor speed to vary the first output;

a lag variable speed motor operable to drive the lag compressor at a second compressor speed to vary the second output;

a sensor operable to measure a system load; and a lead motor drive operable to control the speed of the lead variable speed motor and to set a desired operating state of the lag variable speed motor in response to a comparison of the system load and the system output, wherein the lead motor drive switches the lead compressor between a first region of operation and a second region of operation in response to a measured system load equal to a maximum output of the lead compressor.

7. The compressor system of claim 6, wherein the lead compressor operates between a first minimum and the maximum in the first region of operation and a second minimum and the maximum in the second region of operation, the first minimum being less than the second minimum.

8. A compressor system comprising:

a lead compressor operable to produce a flow of compressed fluid at a first output;

a lag compressor operable to produce a flow of compressed fluid at a second output, the sum of the first output and the second output defining a system output;

a lead variable speed motor operable to drive the lead compressor at a first compressor speed to vary the first output;

a lag variable speed motor operable to drive the lag compressor at a second compressor speed to vary the second output;

a sensor operable to measure a system load; and a lead motor drive operable to control the speed of the lead variable speed motor and to set a desired operating state of the lag variable speed motor in response to a compression of the system load and the system output, wherein the lag compressor is one of a plurality of lag compressors, the plurality of lag compressors operable to produce a plurality of second outputs, the sum of the first output and the plurality of second outputs defining the system output;

wherein the lag variable speed motor is one of a plurality of lag variable speed motors, the lag variable speed motors operable to control the speeds of the plurality of lag compressors; and wherein the lead motor drive provides a desired operating state to each of the plurality of lag variable speed motors in response to the comparison of the system load and the system output.

9. A compressor system comprising:

a lead compressor operable to produce a flow of compressed fluid at a first output;

a lag compressor operable to produce a flow of compressed fluid at a second output, the sum of the first output and the second output defining a system output;

a lead variable speed motor operable to drive the lead compressor at a first compressor speed to vary the first output;

a lag variable speed motor operable to drive the lag compressor at a second compressor speed to vary the second output;

a sensor operable to measure a system load;

a lag motor drive operable to control the speed of the lag variable speed motor; and a lead motor drive operable in a first region of operation to drive the lead variable speed motor at a speed that maintains the first output between a first minimum and a first maximum, and to provide a desired operating state to the lag motor drive to maintain the second output between a second minimum and a second maximum, the lead motor drive also operable in a second region of operation to drive the lead variable speed motor at a speed that maintains the first output between a third minimum and a third maximum, the third minimum being different than the first minimum.

10. The compressor system of claim 9, wherein the third minimum is less than the first minimum and the first maximum, second maximum, and third maximum are all equal.

11. The compressor system of claim 9, wherein the system is operates in one of a low-load region of operation, in which the system load is less than the maximum output of the lead compressor, and a high-load region of operation, in which the system load is greater than the maximum output of the lead compressor.

12. The compressor system of claim 9, wherein the lead motor drive switches from the first region of operation to the second region of operation when the system load is substantially equal to the first maximum, and the lead motor drive continues to operate in the second region of operation when the system load is less than or equal to the first maximum.

13. The compressor system of claim 9, wherein the lead motor drive operates in the first region of operation when the system load is greater than the first maximum.

14. The compressor system of claim 9, wherein the first maximum, second maximum, and third maximum are all about 100 percent, the first minimum is about 70 percent, the second minimum is about 30 percent, and the third minimum is about 30 percent.

15. The compressor system of claim 9, wherein the lag compressor does not operate in the second region of operation.

16. The compressor system of claim 9, wherein the lag motor drive communicates with the lead motor drive to receive the desired operating state from the lead motor drive.

17. The compressor system of claim 16, wherein the lag motor drive communicates with the lead motor drive through a serial communications connection.

18. The compressor system of claim 9, wherein the operating state is one of "on" and "off".

19. The compressor system of claim 18, wherein in the "on" state, the lag motor drive controls the speed of the lag variable speed motor in response to a comparison of the system load and the system output.

20. A method of operating multiple compressors in a compressor system, the method comprising:

operating a lead compressor between a minimum output and a maximum output to define a lead compressor output;

operating a lag compressor between a minimum output and a maximum output to define a lag compressor output;

combining the lead compressor output and the lag compressor output to define a system output;

measuring a system load with a sensor;

comparing the system load and the system output;

setting the speed of the lead compressor using a lead variable speed drive;

determining a desired operating state for the lag compressor using the lead variable speed drive and a comparison of the system load and the system output;

providing to a lag variable speed drive the desired operating state; and operating the lag compressor in the desired operating state in response to receipt of the desired operating state.

21. The method of claim 20, further comprising operating the lead compressor and the lag compressor at the same target pressure.

22. The method of claim 20, further comprising transitioning from a low-load region of operation to a high-load region of operation in response to a measured system load about equal to the maximum output of the lead compressor;

resetting the minimum output of the lead compressor to a second minimum output that is greater than the minimum output; and initiating operation of the lag compressor.

23. The method of claim 20, further comprising transitioning from a high-load region of operation to a low-load region of operation in response to a measured system load about equal to the maximum output of the lead compressor;

resetting the minimum output to the first minimum; and terminating operation of the lag compressor.

24. The method of claim 20, wherein operating the lag compressor in the desired operating state includes one of turning the lag compressor on and turning the lag compressor off.

25. The method of claim 24, wherein turning the lag compressor on further includes varying the operation of the lag compressor in response to the comparison of the system load and the system output.

* * * * *